US010429040B2

(12) United States Patent
Gurwicz et al.

(10) Patent No.: US 10,429,040 B2
(45) Date of Patent: Oct. 1, 2019

(54) INTERCHANGEABLE ADAPTER FOR CHANGING LED LIGHT BULBS

(71) Applicant: GR Ventures L.L.C., Northfield, NJ (US)

(72) Inventors: Joseph Gurwicz, Egg Harbor Township, NJ (US); Michael Rosen, Boca Raton, FL (US)

(73) Assignee: GR Ventures L.L.C., Northfield, NJ (US)

( * ) Notice: Subject to any disclaimer, the term of this patent is extended or adjusted under 35 U.S.C. 154(b) by 476 days.

(21) Appl. No.: 15/130,618

(22) Filed: Apr. 15, 2016

(65) Prior Publication Data

US 2016/0230968 A1 Aug. 11, 2016

Related U.S. Application Data

(63) Continuation-in-part of application No. 15/050,021, filed on Feb. 22, 2016, which is a continuation-in-part
(Continued)

(51) Int. Cl.
*F21V 19/04* (2006.01)
*F21V 19/00* (2006.01)
(Continued)

(52) U.S. Cl.
CPC ..... *F21V 19/042* (2013.01); *B25B 11/007* (2013.01); *H01J 9/003* (2013.01);
(Continued)

(58) Field of Classification Search
CPC ..... B23P 19/04–08; B25B 13/02–08; B25B 13/58; B25B 11/007; B60Q 1/26;
(Continued)

(56) References Cited

U.S. PATENT DOCUMENTS 363,332 A 5/1887 Hammer
544,605 A 8/1895 Woolcock
(Continued)

FOREIGN PATENT DOCUMENTS

AU 2005202235 A1 12/2005
GB 2278585 12/1994
(Continued)

OTHER PUBLICATIONS

International Search Report and Written Opinion issued in PCT/US2017/018293 dated May 16, 2017.
(Continued)

*Primary Examiner* — Peter Dungba Vo
*Assistant Examiner* — Kaying Kue
(74) *Attorney, Agent, or Firm* — Blank Rome LLP

(57) ABSTRACT

An interchangeable adapter for changing a light bulb that includes a head piece that has a base plate with opposite first and second sides and that defines a platform at the first side. A primary gripping member extends from the platform of the first side of the base plate away from the second side. The primary gripping member is positioned substantially centrally with respect to the platform to engage the light bulb. A secondary gripping member extends from the platform of the first side of the base plate away from the second side. The secondary gripping member surrounds the primary gripping member and is configured to grip the light bulb. An engagement member extends from the second side of the base plate away from the first side for engaging a holder of the adapter.

18 Claims, 11 Drawing Sheets

Related U.S. Application Data of application No. 14/457,871, filed on Aug. 12, 2014.

(60) Provisional application No. 61/987,175, filed on May 1, 2014.

(51) Int. Cl.

| | |
|---|---|
| ***B25B 11/00*** | (2006.01) |
| ***H01J 9/00*** | (2006.01) |
| *F21K 9/233* | (2016.01) |
| *F21Y 115/10* | (2016.01) |

(52) U.S. Cl.

CPC ..... *F21K 9/233* (2016.08); *F21Y 2115/10* (2016.08); *Y10T 29/49119* (2015.01); *Y10T 29/49171* (2015.01)

(58) Field of Classification Search

CPC ..... Y10T 29/49815; Y10T 29/49826; Y10T 29/49119; Y10T 29/49171; H01K 3/00–32; F21V 19/001; F21V 19/00–06; F21V 19/042; H01J 9/003; F21K 9/233; F21Y 2115/10

USPC ..... 29/729, 762, 760, 764, 739

See application file for complete search history.

(56) References Cited

U.S. PATENT DOCUMENTS

| | | | | |
|---|---|---|---|---|
| 2,117,017 | A | 5/1938 | Chadsey | |
| 2,157,563 | A | 5/1939 | Pethick | |
| 2,634,998 | A | 4/1953 | Flower | |
| 2,637,587 | A | 5/1953 | Cecil | |
| 2,722,448 | A | 11/1955 | Popp | |
| 2,766,060 | A | 10/1956 | Fuller | |
| 4,663,996 | A * | 5/1987 | Grudgfield | H01K 3/32 294/99.1 |
| D297,499 | S | 9/1988 | Whitney | |
| 4,864,899 | A | 9/1989 | Morse | |
| 4,872,097 | A | 10/1989 | Miller | |
| 5,148,723 | A | 9/1992 | Newman, Sr. et al. | |
| 5,218,889 | A | 6/1993 | Brockberg | |
| D345,899 | S | 4/1994 | Friend | |
| 5,317,939 | A | 6/1994 | Marinescu | |
| 5,440,867 | A | 8/1995 | Strus | |
| 5,809,850 | A * | 9/1998 | Tickner | H01J 9/006 294/209 |
| 6,223,628 | B1 | 5/2001 | Barron | |
| 6,257,095 | B1 | 7/2001 | Yukness | |
| 6,320,608 | B1 * | 11/2001 | Yap | B25B 13/48 348/143 |
| D484,013 | S | 12/2003 | Alverson, Jr. | |
| 6,692,142 | B1 * | 2/2004 | Gordin | B60P 3/18 362/413 |
| D490,670 | S | 6/2004 | Ball et al. | |
| 7,143,668 | B2 | 12/2006 | Johnson et al. | |
| D544,007 | S | 6/2007 | Marasco | |
| D545,333 | S | 6/2007 | Clarke | |
| 7,255,024 | B2 * | 8/2007 | Johnson | H01J 9/003 81/53.1 |
| 7,270,031 | B1 | 9/2007 | Huls | |
| 7,334,503 | B1 | 2/2008 | Newman | |
| 7,367,347 | B2 | 5/2008 | Field | |
| 7,562,605 | B2 | 7/2009 | Kunkel | |
| 7,631,579 | B2 * | 12/2009 | Johnson | H01J 9/003 81/53.12 |
| D610,887 | S | 3/2010 | Vivatvanit | |
| 7,891,716 | B2 * | 2/2011 | Orr | B25B 27/00 294/209 |
| 8,274,241 | B2 * | 9/2012 | Guest | H05B 33/0803 315/294 |
| 8,281,470 | B2 * | 10/2012 | Orr | A62C 31/28 29/242 |
| D672,518 | S * | 12/2012 | Facteau | D32/35 |
| 8,476,812 | B2 * | 7/2013 | Chan | B21K 21/10 313/45 |
| 8,539,863 | B2 | 9/2013 | Gatski | |
| 8,546,362 | B2 | 10/2013 | Sulur et al. | |
| 8,555,749 | B2 | 10/2013 | Gatski | |
| 8,657,351 | B2 | 2/2014 | Johnson | |
| 8,844,407 | B2 * | 9/2014 | Johnson | A47L 13/38 81/53.2 |
| 8,926,140 | B2 * | 1/2015 | Wheelock | F21V 19/001 362/294 |
| 9,070,544 | B1 * | 6/2015 | Shaps | H01K 3/32 |
| 9,093,241 | B1 | 7/2015 | Gatski | |
| D745,347 | S * | 12/2015 | Gurwicz | D8/14 |
| 9,222,568 | B2 | 12/2015 | Schroedl | |
| 9,613,794 | B2 | 4/2017 | Becker | |
| 2002/0117870 | A1 | 8/2002 | Cash | |
| 2005/0178246 | A1 | 8/2005 | Johnson et al. | |
| 2009/0141508 | A1 * | 6/2009 | Peng | F21V 23/02 362/373 |
| 2010/0024606 | A1 | 2/2010 | Becker | |
| 2010/0096992 | A1 * | 4/2010 | Yamamoto | F21V 23/006 315/112 |
| 2010/0098992 | A1 | 4/2010 | Yamamoto et al. | |
| 2011/0089830 | A1 * | 4/2011 | Pickard | F21V 29/54 315/32 |
| 2012/0103141 | A1 | 5/2012 | Workman | |
| 2012/0182737 | A1 * | 7/2012 | Kuenzler | F21V 29/004 362/249.02 |
| 2012/0222521 | A1 * | 9/2012 | Becker | H01K 3/32 81/53.11 |
| 2013/0135888 | A1 | 5/2013 | Le Bars et al. | |

FOREIGN PATENT DOCUMENTS

| | | | |
|---|---|---|---|
| JP | 668293 | U | 9/1994 |
| JP | 08161923 | A | 6/1996 |
| JP | 2011070784 | A | 4/2011 |
| KR | 20070107429 | A | 11/2007 |
| WO | WO-8404627 | A1 | 11/1984 |
| WO | WO-2005112076 | A2 | 11/2005 |

OTHER PUBLICATIONS

Light Bulb Change patent—Google search—https:www.google.com/search?q=light+bulb+changer+patent&newwi. .; 12 pages; Mar. 31, 2014.

Cleaning Supplies/Cleaning Tools/Stickyfingers Bulb Changer—Pkg Q. .. ; http://www.globalindustrial.com/p/janitorial-maintenance/cleaning-sup . . . ; 2 pages; Mar. 31, 2014.

Notification Concerning Transmittal of International Preliminary Report on Patentability, PCT/US2015/027935, dated Nov. 10, 2016.

Supplementary European Search Report, EP 15 78 5311, dated Jan. 9, 2017.

* cited by examiner

INTERCHANGEABLE ADAPTER FOR CHANGING LED LIGHT BULBS

REFERENCE TO RELATED APPLICATIONS

The present application is a continuation-in-part of and claims the benefit of U.S. patent application Ser. No. 15/050,021, filed Feb. 22, 2016, which is a continuation-in-part of U.S. patent application Ser. No. 14/457,871 filed Aug. 12, 2014, which claims the benefit of U.S. Provisional Patent Application No. 61/987,175, filed May 1, 2014, the disclosures of which are hereby incorporated in their entirety into the present disclosure.

FIELD OF THE INVENTION

The present invention is directed to an interchangeable adapter for changing light bulbs and more particularly to an interchangeable adapter for changing LED (light-emitting diode) light bulbs.

DESCRIPTION OF RELATED ART

Light-bulb changers are known in the art and allow a user to change a light bulb without using a step ladder or touching a hot bulb. A typical changer comprises a grabber for grabbing a light bulb, attached to a pole for allowing a user to reach the light bulb with the grabber. The grabber includes flexible fingers for engaging the light bulb and allowing the user to unscrew the light bulb. A changer can be sold with multiple grabbers for different sizes and shapes of light bulbs, each of them removably attachable to the pole with a threaded connection. The grabbers are designed for use with roughly spherical incandescent light bulbs, spotlight bulbs, and compact fluorescent light (CFL) bulbs.

In an unrelated development, LED light bulbs are increasingly popular, at least in part because of federal regulations. A typical LED light bulb, which can be designed to fit into the same socket as a traditional incandescent light bulb, is shown in FIGS. 1-3 as 100. The light bulb 100 includes a heat sink 102 of aluminum or a similar material around the lighting element. The heat sink has multiple cooling fins 104 (omitted from FIG. 1 for clarity, but shown in FIGS. 2 and 3) radiating from the axis A of the bulb 100; in many designs, the fins 104 extend to the front of the bulb 100 and are supported by a ring 106. The fins 104 define spaces 108 therebetween.

However, LED light bulbs are typically shaped differently from conventional incandescent, halogen, or compact fluorescent light bulbs. For example, the bulb 100 of FIGS. 1-3 has a flat face and a sharply sloping back. As a consequence, traditional changers do not work with many LED light bulbs. Because of the different shape, the flexible fingers of the grabber often cannot engage with the bulb, nor can they enter the spaces 108. The LED light bulbs may also be of different diameters, such as the PAR 30 and PAR 38.

SUMMARY OF THE INVENTION

It is therefore an object of the invention to provide a light-bulb changer for changing LED light bulbs.

To achieve the above and other objects, the present invention is directed to an adapter for changing LED light bulbs. The adapter can have a threaded fitting for attachment to the pole of an existing light-bulb changer. The adapter has a body, preferably formed of a rigid material such as a rigid plastic. The body has multiple teeth to engage the spaces between the cooling fins of the LED light bulb. The light bulb can then be unscrewed from its socket and lowered using the pole and the adapter. A new light bulb can be placed on the teeth, raised, and screwed into the socket.

The adapter can be designed for each type of LED light bulb and for the pole to which it is to be attached. The adapter has the correct number of teeth, and the correct length of each tooth, to engage the light bulb for removal. The teeth typically face directly forward, parallel to the axis of the adapter, to allow easy insertion of the teeth into the spaces and easy removal once the light bulb has been lowered from its socket. The adapter is also designed to attach to the pole; as a result, the adapter can have a conical, hemispherical, or similar shape.

Multiple such adapters can be sold together as a kit for changing multiple types of light bulbs. An adapter can be sold with a pole, with screw adapters for mounting on different types of poles, or separately.

The present invention also provides a head piece for an adapter for changing a light bulb that includes a base plate that has opposite first and second sides, and a perimeter defined between first and second sides, and the base plate defines a platform at the first side. A plurality of teeth extend from the platform of the first side of the base plate away from the second side. The plurality of teeth are spaced and arranged on the platform to engage the light bulb. An engagement member extends from the second surface of the base plate away from the first side for engaging a holder of the adapter.

The present invention further provides an interchangeable adapter for changing a light bulb that includes a holder that has a mounting end and an interface end opposite the mounting end, and a first engagement member disposed inside of the holder. At least one head piece that is separate from the holder is releasably coupled thereto at the interface end of the holder. The head piece has a base plate with opposite first and second sides, and the first side defines a platform. A plurality of teeth extend from the platform of the first side of the base plate. The plurality of teeth are spaced and arranged on the platform to engage the light bulb. A second engagement member extends from the second side of the base plate for engaging the first engagement member of the holder.

The present invention yet further provides a method for changing a light bulb that includes the steps of providing a holder of an adapter for changing the light bulb, the holder having a mounting end and an interface end opposite the mounting end, and a first engagement member disposed inside of the holder; providing a plurality of head pieces, each of the head pieces having, a base plate with opposite first and second sides, the first side defining a platform, a plurality of teeth extending from the platform of the first side of the base plate, the plurality of teeth being spaced and arranged on the platform to engage the light bulb, and a second engagement member extending from the second side of the base plate for releasably engaging the first engagement member of the holder; selecting one of the plurality of head pieces; and coupling the selected one of the plurality of head pieces with the interface end of the holder by releasably coupling the first and second engagement members.

The present invention may still further provide a headpiece for an interchangeable adapter for changing a light bulb that includes a base plate with opposite first and second sides and that defines a platform at the first side. A primary gripping member extends from the platform of the first side of the base plate away from the second side. The primary gripping member is positioned substantially centrally with respect to the platform to engage the light bulb. A secondary gripping member extends from the platform of the first side of the base plate away from the second side. The secondary gripping member surrounds the primary gripping member and is configured to grip the light bulb. An engagement member extends from the second side of the base plate away from the first side for engaging a holder of the adapter. In a preferred embodiment, the primary gripping member is a suction cup.

The present invention may further provide an interchangeable adapter for changing a light bulb that includes a holder that has a mounting end and an interface end opposite the mounting end and a first engagement member disposed inside of the holder. At least one head piece that is separate from the holder and releasably coupled thereto at the interface end of the holder. The head piece includes a base plate that has opposite first and second sides and defines a platform at the first side. A primary gripping member extends from the platform of the first side of the base plate away from the second side. The primary gripping member is positioned substantially centrally with respect to the platform to engage the light bulb. A secondary gripping member extends from the platform of the first side of the base plate away from the second side. The secondary gripping member surrounds the primary gripping member and is configured to grip the light bulb. A second engagement member extends from the second side of the base plate away from the first side for engaging the first engagement member of the holder.

The present invention may yet further provide a method for changing a light bulb, including the steps of providing an adapter having a holder and a head piece releasably mounted thereto, the head piece including a base plate having opposite first and second sides, the base plate defining a platform at the first side, a primary gripping member extending from the platform of the first side of the base plate away from the second side, the primary gripping member being positioned substantially centrally with respect to the platform, and a secondary gripping member extending from the platform of the first side of the base plate away from the second side, the secondary gripping member surrounding the primary gripping member; gripping the light bulb with the primary gripping member of the adapter; and subsequent to gripping the light bulb with the primary gripping member, moving the adapter toward the light bulb until the secondary gripping member grips the light bulb.

BRIEF DESCRIPTION OF THE DRAWINGS

Preferred embodiments of the invention will be set forth in detail with reference to the drawings, in which.

DETAILED DESCRIPTION OF THE PREFERRED EMBODIMENTS

Figure 1:
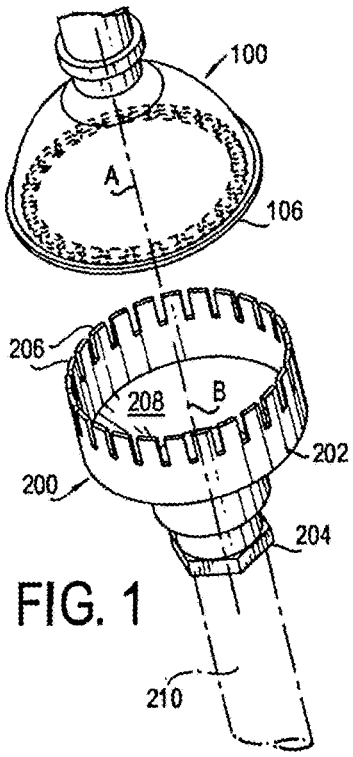
FIG. 1 is a perspective view showing the adapter according to the preferred embodiment being brought into engagement with a light bulb.

Preferred embodiments of the invention will be described in detail with reference to the drawings, in which like reference numerals refer to like elements or steps throughout.

Figure 2:
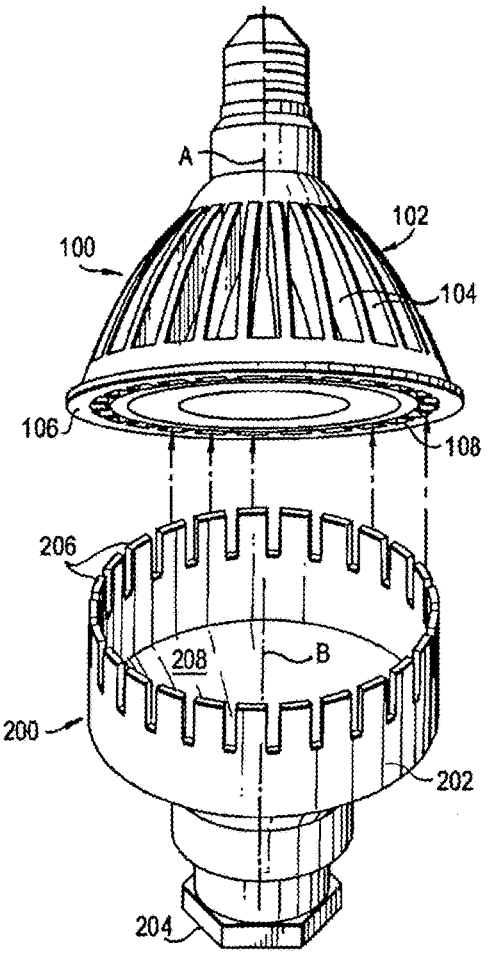
FIG. 2 is a view showing the interrelations among the parts of the adapter and light bulb of FIG. 1.
Figure 3:
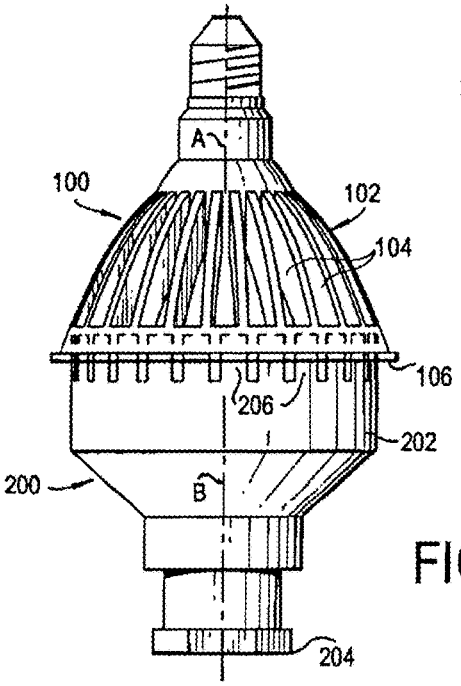
FIG. 3 is a side view showing the adapter and light bulb of FIG. 1 when they are engaged with each other.

FIGS. 1-3 show an adapter 200 according to a preferred embodiment. Because the adapter is designed to be used with a particular light bulb, its proportions, including its diameter and the number and length of teeth, are selected for that particular light bulb.

The adapter 200 has a body 202. At one end of the body 202 is a mount 204, such as a threaded mount, designed to mount the adapter 200 onto the pole 210 of a light-bulb changer, which can be a light-bulb changer now on the market or yet to be introduced. At the other end are teeth 206 for engaging with the light bulb in a manner to be explained below. The teeth 206 extend parallel to the axis B of the adapter 200 for easy engagement and disengagement with the light bulb. Because the end with the mount 204 and the end with the teeth 206 typically have different diameters, the body 202 has a shape, such as a cone or a hemisphere, although any other suitable shape can be chosen.

The adapter 200 can be made in any suitable way, such as by molding or by machining, and out of any suitable material, such as rigid plastic. It is contemplated that the body 202 will have an empty space 208 to reduce both the weight of the adapter 200 and the amount of material used; however, the body 202 could be solid if so desired.

FIG. 3 shows the engagement of the light bulb 100 and the adapter 200. The light bulb 100 and the adapter 200 are brought into a coaxial arrangement facing each other, and the teeth 206 are inserted into the spaces 108. By turning the adapter 200 (e.g., by turning the pole), the user turns the light bulb 100 to screw it into or unscrew it from the socket. Once the light bulb 100 is screwed in, the adapter 200 can simply be lowered, or once the light bulb 100 is unscrewed and lowered, it can simply be taken off of the adapter. As the light bulb 100 is raised or lowered, the body 202 and the teeth 206 support the light bulb 100 against falling off of the adapter 200.

Figure 4:
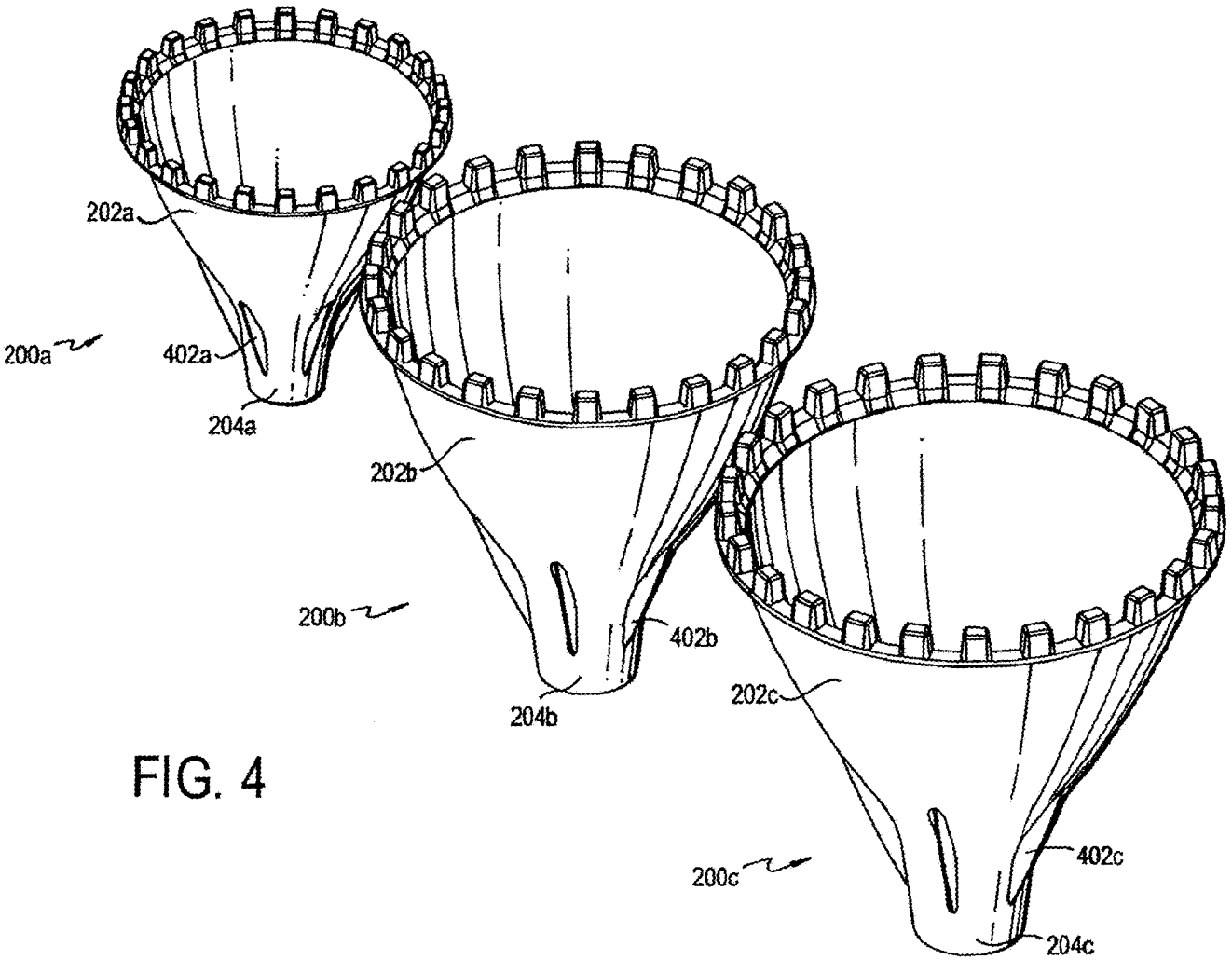
FIG. 4 is a perspective view showing a set of three adapters sized for different light bulbs according to a variation of the preferred embodiment.

FIG. 4 is a perspective view showing three adapters 200*a*, 200*b*, 200*c* according to a variation of the preferred embodiment. The three adapters 200*a*, 200*b*, 200*c* are sized for different light bulbs. Of course, they can be packaged together or sold separately.

Each adapter 200*a*, 200*b*, 200*c* has a body 202*a*, 202*b*, 202*c* having curved sides. Ribs 402*a*, 402*b*, 402*c* are formed between the body 202*a*, 202*b*, 202*c* and the mount 204*a*, 204*b*, 204*c*. Otherwise, the adapters 200*a*, 200*b*, 200*c* can be formed like the adapter 200 of FIGS. 1-3.

Figure 5:
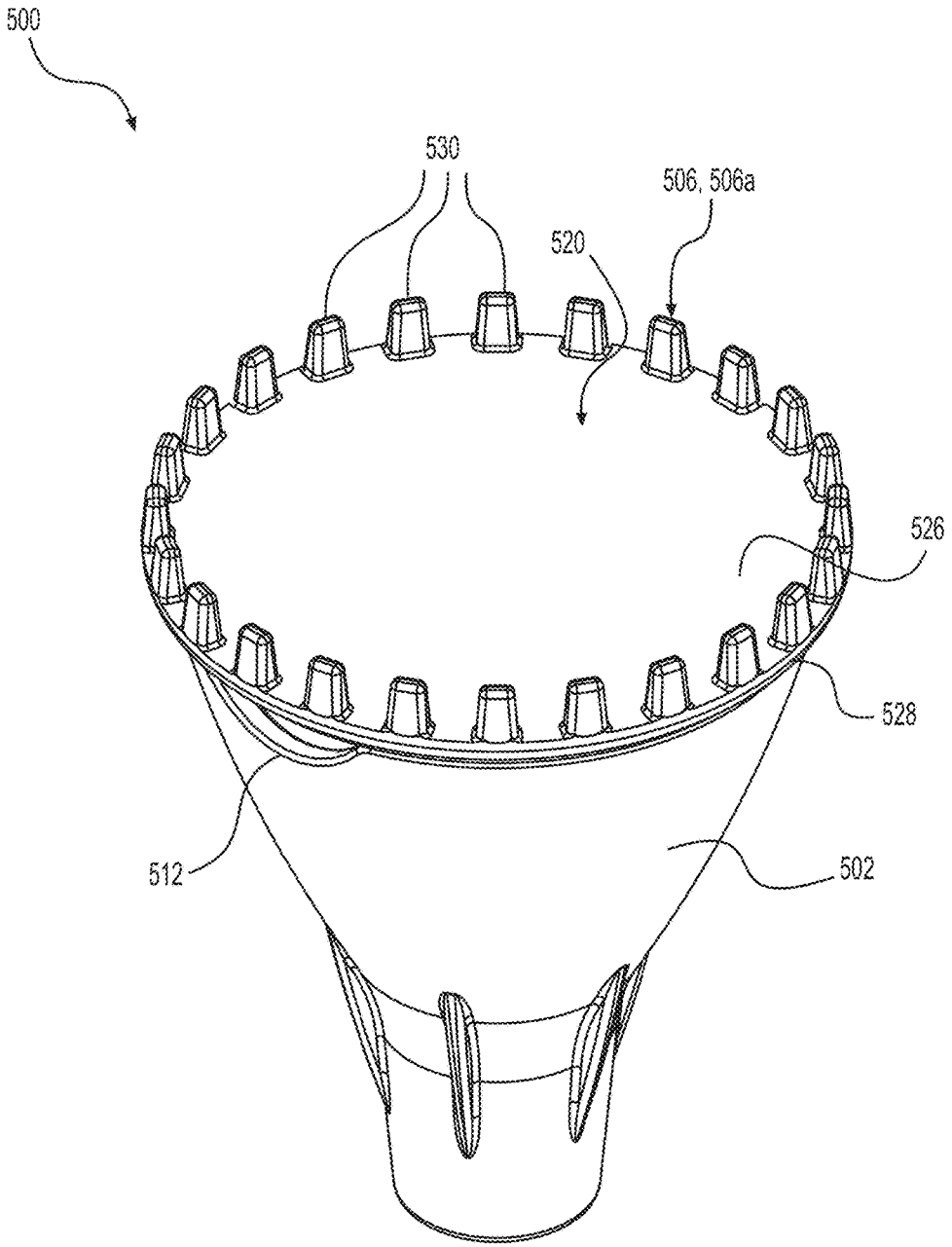
FIG. 5 is a top perspective view of an interchangeable adapter in accordance with an alternative embodiment of the present invention, showing a holder and a selected head piece of the adapter.
Figure 6:
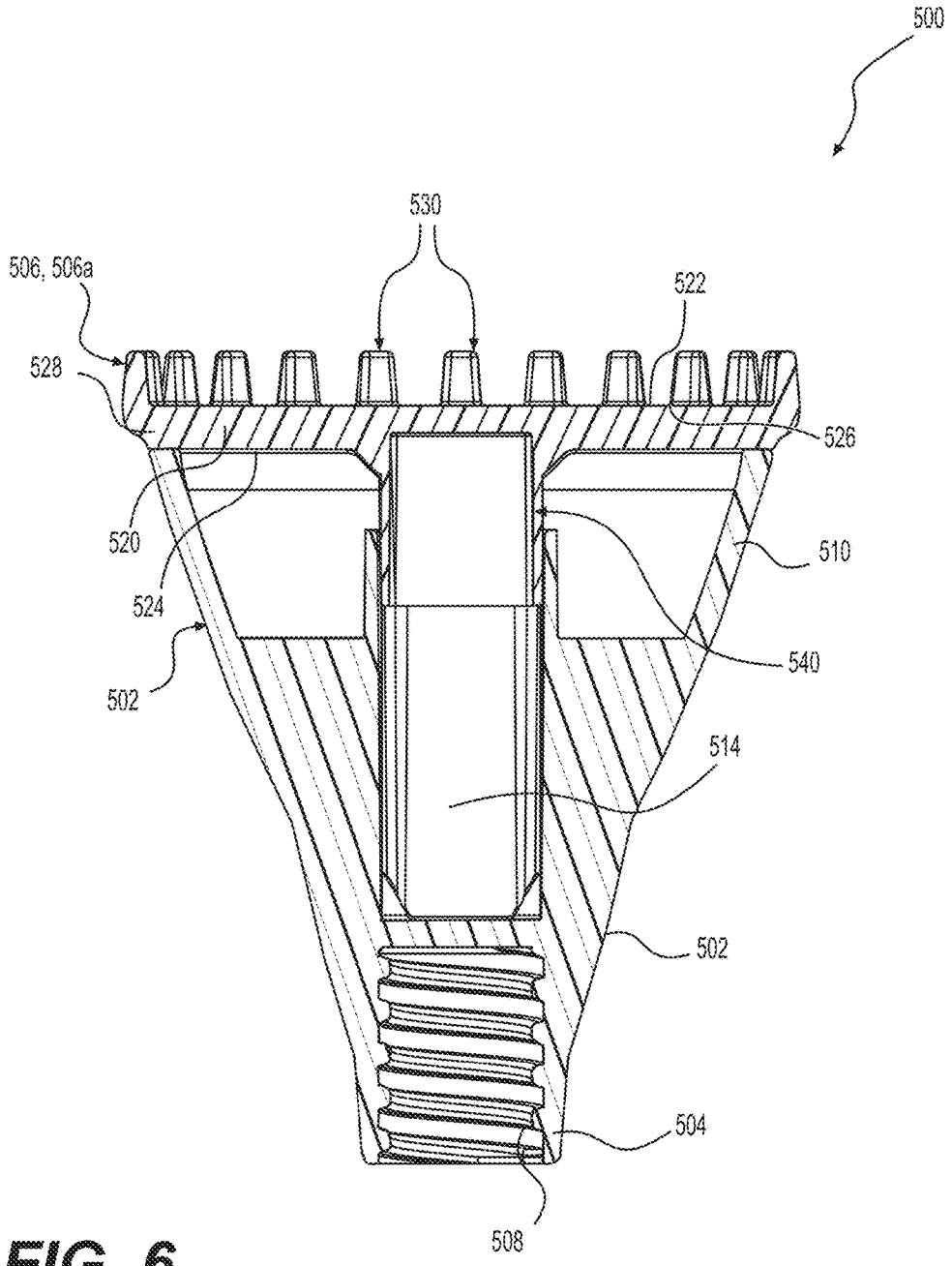
FIG. 6 is a cross-sectional view of the interchangeable adapter illustrated in FIG. 5.
Figure 7:
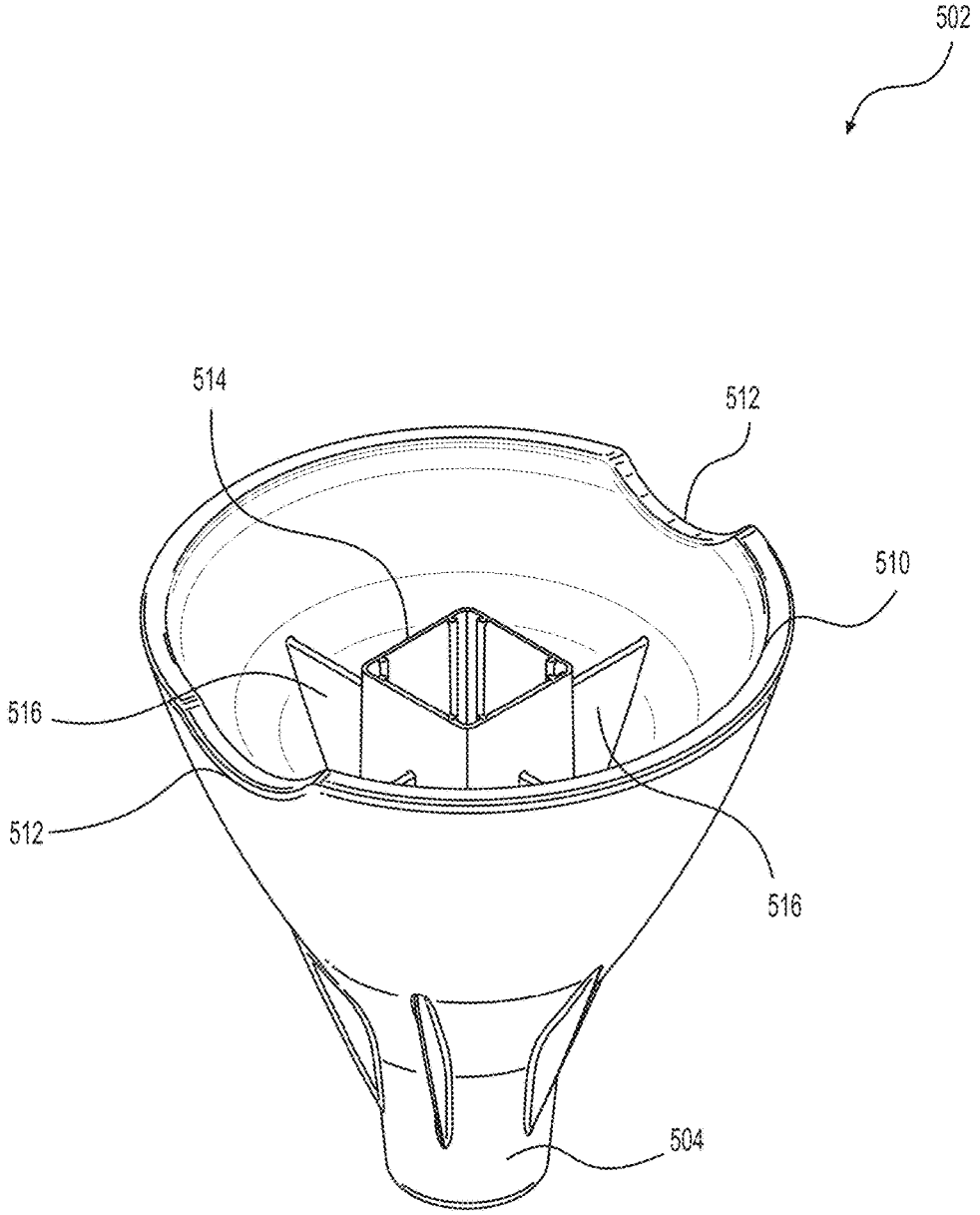
FIG. 7 is a top perspective view of the holder of the interchangeable adapter illustrated in FIG. 5.

FIGS. 5-7 illustrate an alternative embodiment of the present invention of an interchangeable adapter 500 which allows the user to customize the adapter to the particular type and size of the LED light bulb. The interchangeable adapter 500 generally includes a holder 502 and a head piece 506 that fits onto the holder 502, where the head piece may be selected from a plurality of different head pieces, such as head pieces 506*a*, 506*b*, 506*c*, 506*d*, and 506*e*, shown in FIGS. 5, 6, 8A, 8B, 9A, 9B, 10A, 10B, 11A, and 11B, respectively. The holder 502 and the head pieces 506*a*, 506*b*, 506*c*, 506*d*, and 506*e* are preferably formed of a rigid or semi rigid plastic.

As seen in FIG. 7, the holder 502 generally includes a body that has a mounting end 504 adapted to receive an extension or pole to assist the user in reaching the light bulb. The mounting end 504 may have internal threads 508, for example, for engaging the pole. Opposite the mounting end 504 is an interface end 510 that interfaces with and engages with the selected head piece 506. The holder 502 may be substantially cone shaped such that the diameter of its interface end 510 is larger than the mounting end 504. The edge of the interface end 510 may include one or more semi-circular cutouts 512 sized to accommodate a person's finger to assist in removal and replacement of the selected head piece 506. In a preferred embodiment, two cutouts 512 are provided that are disposed opposite one another at the interface end 510. The inside of the holder 502 includes an engagement member 514 configured to engage a corresponding member of the selected head piece 506. The engagement member 514 may be an elongated stem centrally disposed inside of the holder 502, as best seen in FIGS. 6 and 7. One or more strength members 516, such as radial fins, may be provided that extend between the engagement member 514 and the inner wall surface of the holder's body to add rigidity to the inside of the holder 502. The holder 502 may be formed as a one-piece member, or the components may be formed separately and integrally attached.

FIGS. 5 and 6 illustrate a first exemplary embodiment of a selected head piece 506*a*. The head piece 506*a* generally includes a base plate 520 with first and second opposite sides 522 and 524, a plurality of teeth 530 adapted to engage the light bulb that extend from the first side 522, and an engagement member 540 adapted to engage the holder 502 that extends from the second side. In a preferred embodiment, the base plate 520 is substantially circular and defines a platform 526 that supports the plurality of teeth 530. As seen in FIG. 6, the platform 526 has a diameter that is at least the same as the holder's interface end 510, and preferably slightly larger than the interface end 510. The teeth 530 are arranged on the platform 526 to engage the spaces of the light bulb requiring changes, such as spaces 108 (FIG. 3). It is preferred that the number of teeth 530 do not exceed the number of corresponding spaces in the light bulb. However, any number of teeth may be provided including just one tooth. The platform 526 defines a perimeter 528 of the head piece 506*a* that is between the first and second sides 522 and 524. The teeth 530 are preferably arranged at the perimeter 528, thereby forming an annular ring of teeth. As seen in FIG. 5, the teeth 530 may be equally spaced to substantially match the corresponding spaces of the light bulb. The teeth 530 are generally the same height and extend long enough to enter and engage the spaces of the light bulb. The teeth 530 are preferably substantially rigid such that the teeth 530 will not flex when engaging the light bulb.

The engagement member 540 opposite the teeth 530 may be a stem that is slightly shorter and smaller than the elongated stem 514 of the holder 502, thereby allowing the elongated stem 514 of the holder 502 to receive the stem 540 of the head piece 506*a*. In a preferred embodiment, the stems 514 and 540 releasably engage one another in a telescoping friction fit. Other releasable engagement mechanisms may use used, such as a snap or latch engagement. Although the stems 514 and 540 are shown has having a generally square cross-sectional shape, the stems 514 and 540 may have other cross-sectional shapes, such as circular, as long as one of the stems 514 or 540 can receive the other stem 514 or 540 in a telescoping manner.

Figure 8A:
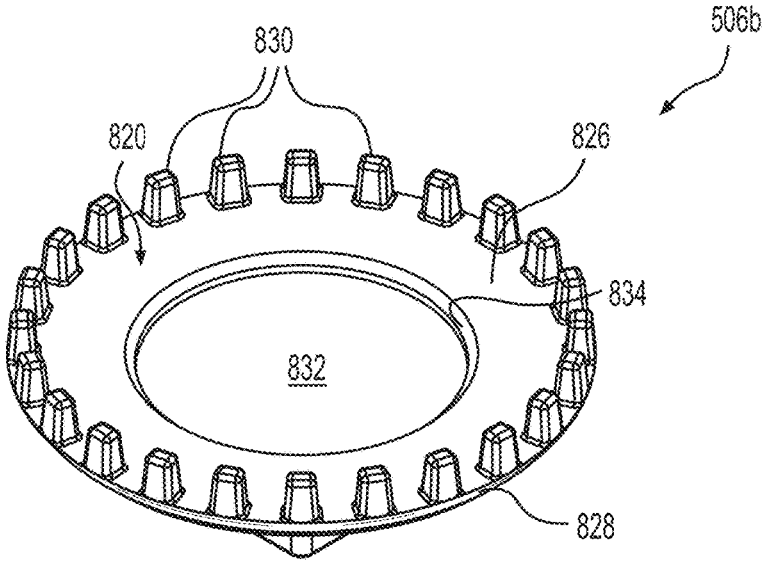
FIGS. 8A and 8B are top perspective and cross-sectional views, respectively, of a head piece of the interchangeable adapter in accordance with an exemplary embodiment of the present invention.
Figure 8B:
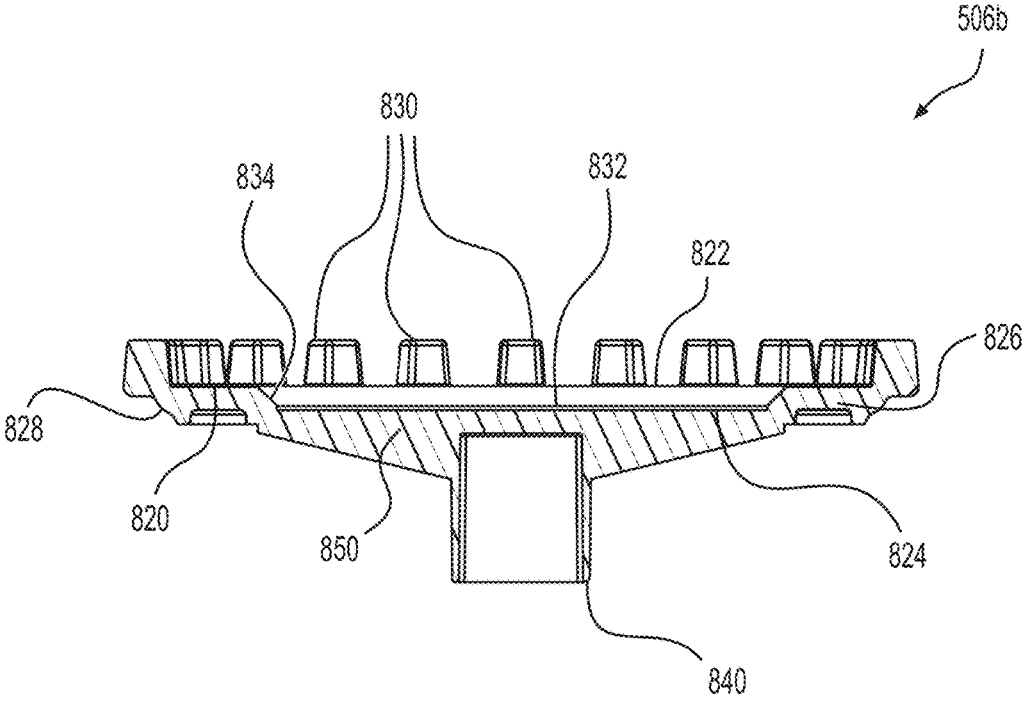

FIGS. 8A and 8B illustrate a second exemplary embodiment of the selected head piece 506*b*. Like the first embodiment, the head piece 506*b* generally includes a base plate 820 with first and second opposite sides 822 and 824, a plurality of teeth 830 extending from the first side 822, and an engagement member 840 extending from the second side 824. As best seen in FIG. 8A, the base plate 820 may optionally include a central recessed area 832 having a ledge 834, thereby defining the platform 826 for supporting the teeth 830 between the ledge 834 and the perimeter 828 of the base plate 820. The recessed area 832 is sized to accommodate any protrusion on the light bulb that may interfere with the adapter grasping the light bulb. The teeth 830 are arranged on the platform 826 at the perimeter 828 and spaced from the ledge 834. Like the teeth 530 of the first embodiment, the teeth 830 are preferably equally spaced and form an annular ring at the perimeter 828 of the base plate 820. Unlike the head piece 506*a* of the first embodiment, the head piece 506*b* of the second embodiment may include strength members 850 at its second side 824. As seen in FIG. 8B, one or more of the strength members 850, such as fins, may extend between the second side 824 of the head piece 506*b* and the engagement member 840.

Figure 9A:
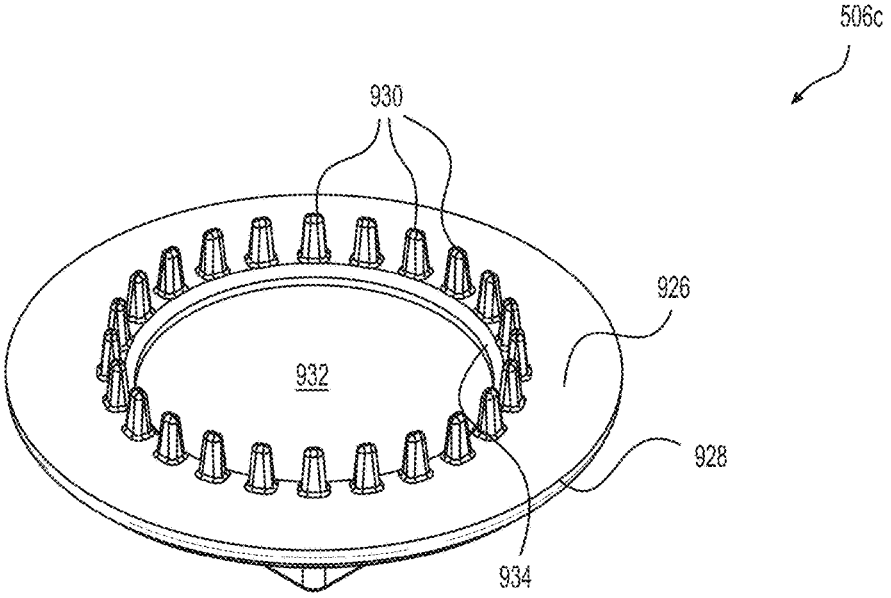
FIGS. 9A and 9B are top perspective and cross-sectional views, respectively, of a head piece of the interchangeable adapter in accordance with another exemplary embodiment of the present invention.
Figure 9B:
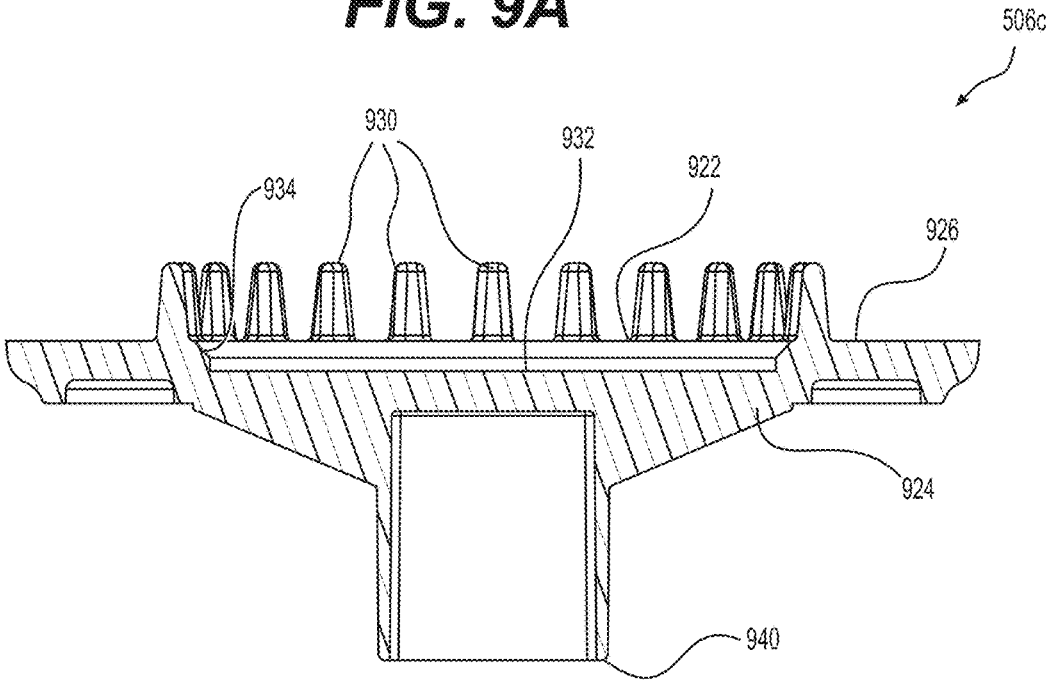

FIGS. 9A and 9B illustrate a third exemplary embodiment of the selected head piece 506*c*. The head piece 506*c* is similar to the head piece 506*b*, except that its teeth 930 are spaced from the perimeter 928 of the head piece. Like the head piece 506*b* of the second embodiment, the head piece 506*c* generally includes a base plate 920 where the plurality of teeth 930 extend from the base plate's first side 922, and an engagement member 940 that extends from the second side 924. And like the second embodiment, the head piece 506*c* of the third embodiment includes a platform 926 for the teeth 930 that is defined between a ledge 934 of an optional central recessed area 932 and the base plate's perimeter 928. Unlike the head piece 506*b* of the second embodiment, the teeth 930 of the third embodiment are spaced from the base plate's perimeter 928 and are preferably disposed adjacent to the ledge 934. As such, the teeth 930 may form an annular ring around the central recessed area 932, as seen in FIG. 9A.

Figure 10A:
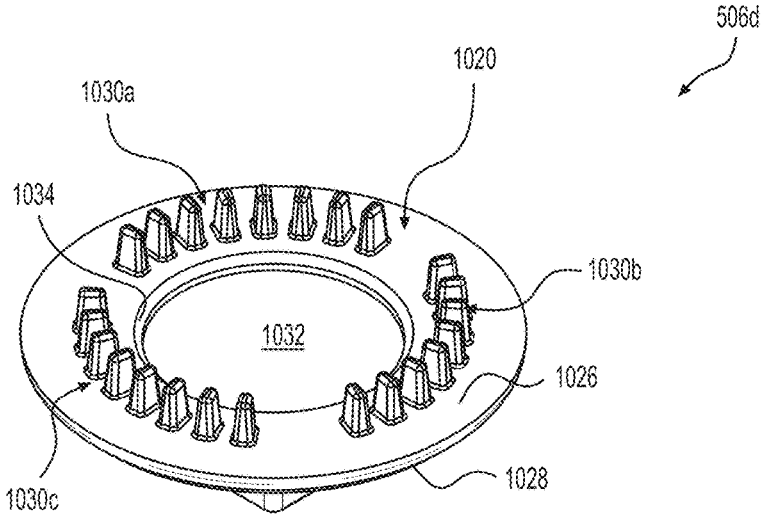
FIGS. 10A and 10B are top perspective and cross-sectional views, respectively, of a head piece of the interchangeable adapter in accordance with still another exemplary embodiment of the present invention.
Figure 10B:
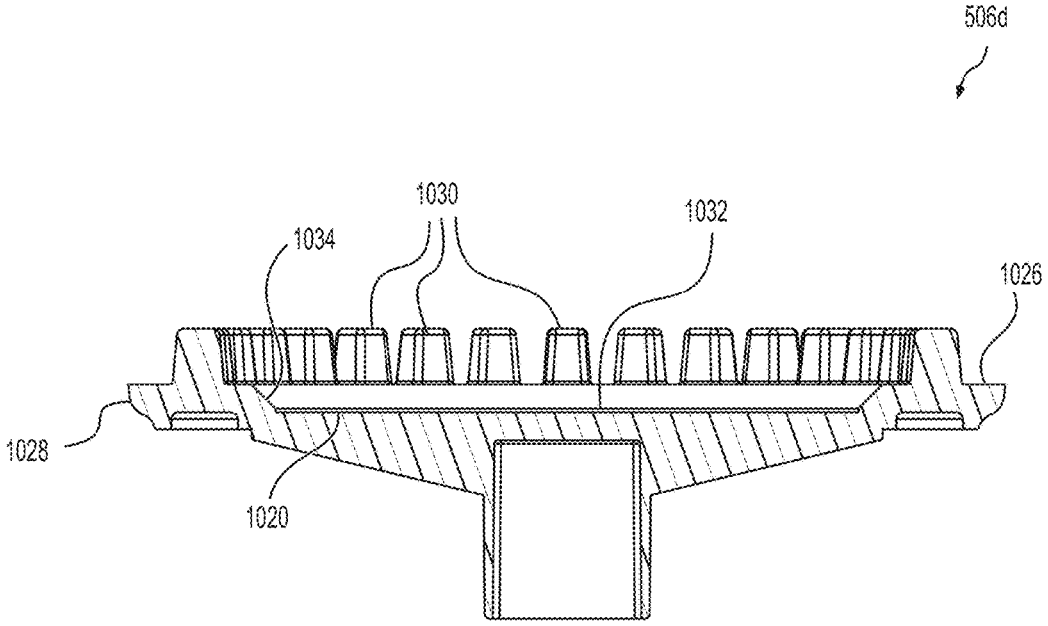

FIGS. 10A and 10B illustrate a fourth exemplary embodiment of the selected head piece 506*d*, which is similar to the third embodiment, except that the teeth 1030 are disposed in groups and are spaced between the ledge 1034 of the central recessed area 1032 and the perimeter 1028 of the base plate 1020. In a preferred embodiment, the teeth 1030 are provided in three groups 1030*a*, 1030*b*, and 1030*c* where the groups 1030*a*, 1030*b*, and 1030*c* are preferably equally spaced from one another on the platform 1026, as best seen in FIG. 10A. Alternatively, any number of groups of the teeth 1030 may be provided depending on the type light bulb to be grasped, including just two groups of teeth. And the number of teeth 1030 in each group 1030*a*, 1030*b*, and 1030*c* is preferably the same. However, the number of teeth in each group 1030*a*, 1030*b*, and 1030*c* may vary. In this embodiment, the groups of teeth 1030*a*, 1030*b*, and 1030*c* are arranged on the platform 1026 so that the teeth 1030 are spaced both from the ledge 1034 and the perimeter 1028.

Figure 11A:
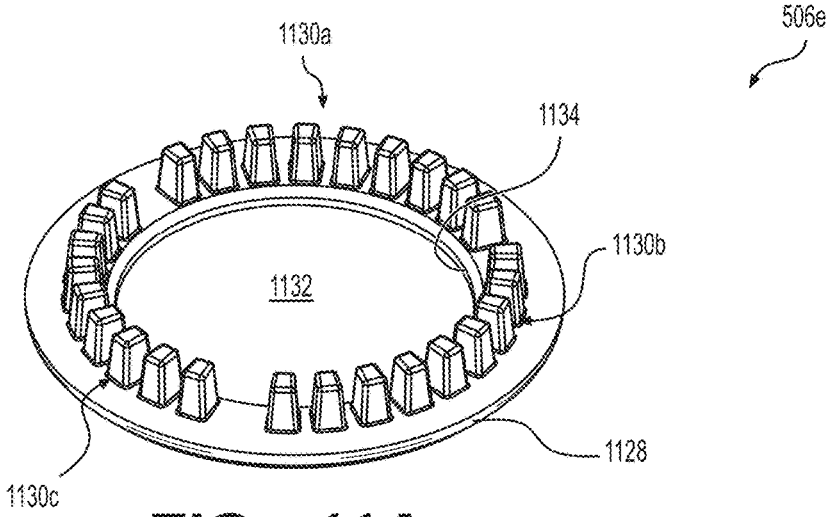
FIGS. 11A and 11B are top perspective and cross-sectional views, respectively, of a head piece of the interchangeable adapter in accordance with yet another exemplary embodiment of the present invention.
Figure 11B:
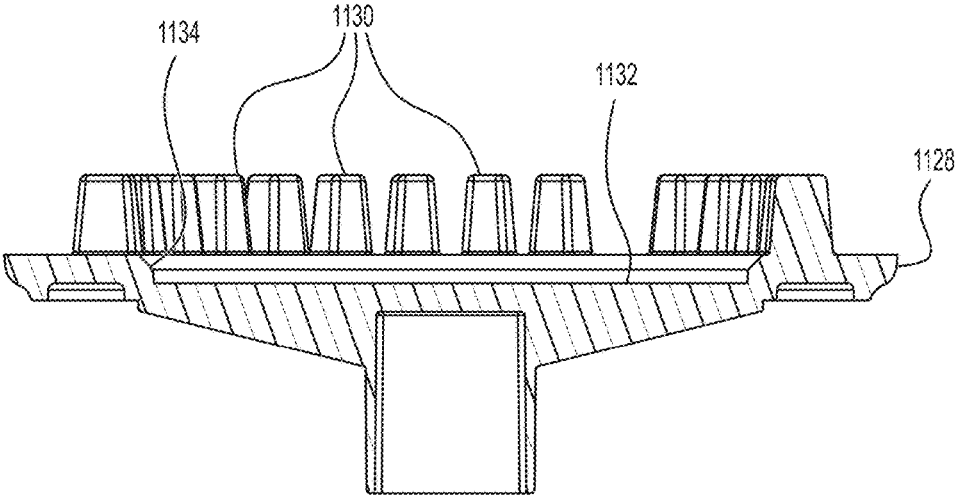

FIGS. 11A and 11B illustrate a fifth exemplary embodiment of the selected head piece 506*e* that is similar to the fourth embodiment, except that the teeth 1130 are located adjacent the ledge 1134 of the central recessed area 1132 and away from the base plate's perimeter 1128. Like the fourth embodiment, the teeth 1130 are preferably arranged in groups 1130*a*, 1130*b*, and 1130*c*; however each group of teeth 1130*a*, 1130*b*, and 1130*c* may have at least one more tooth than the groups 1030*a*, 1030*b*, and 1030*c* of the fourth embodiment.

Figure 12:
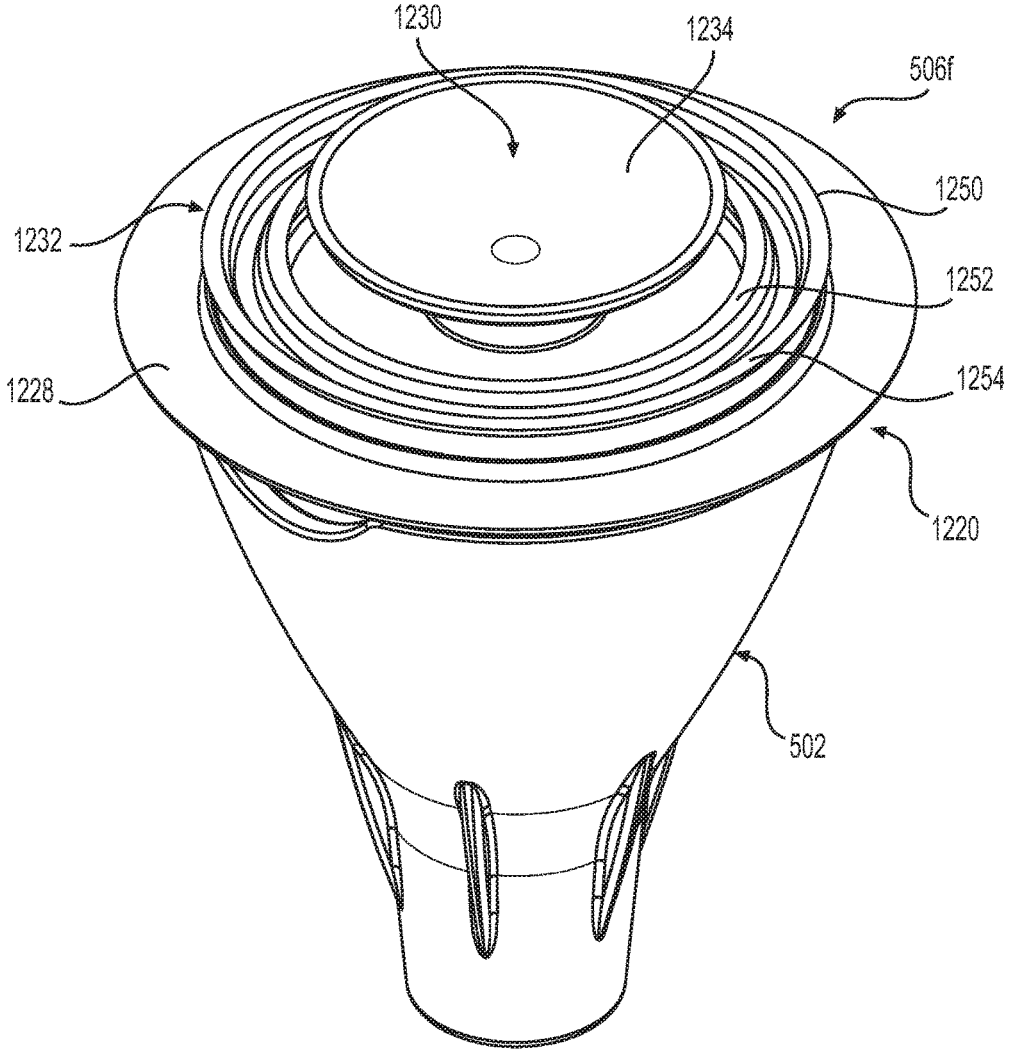
FIG. 12 is a perspective view of a head piece of the interchangeable adapter in accordance with still yet another exemplary embodiment of the present invention, showing the head piece mounted on the holder of the adapter.
Figure 13:
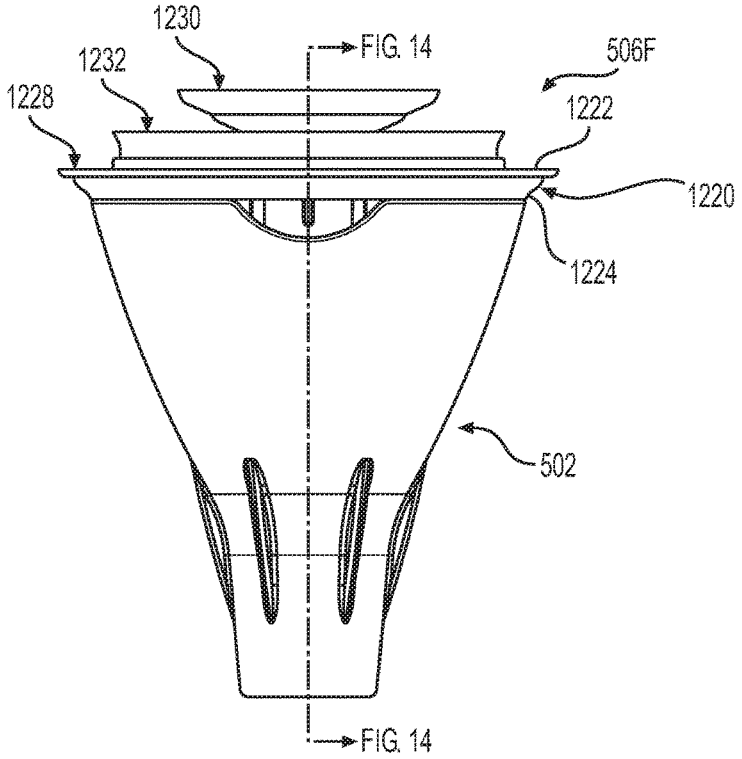
FIG. 13 is a side elevational view of the head piece illustrated in FIG. 12.
Figure 14:
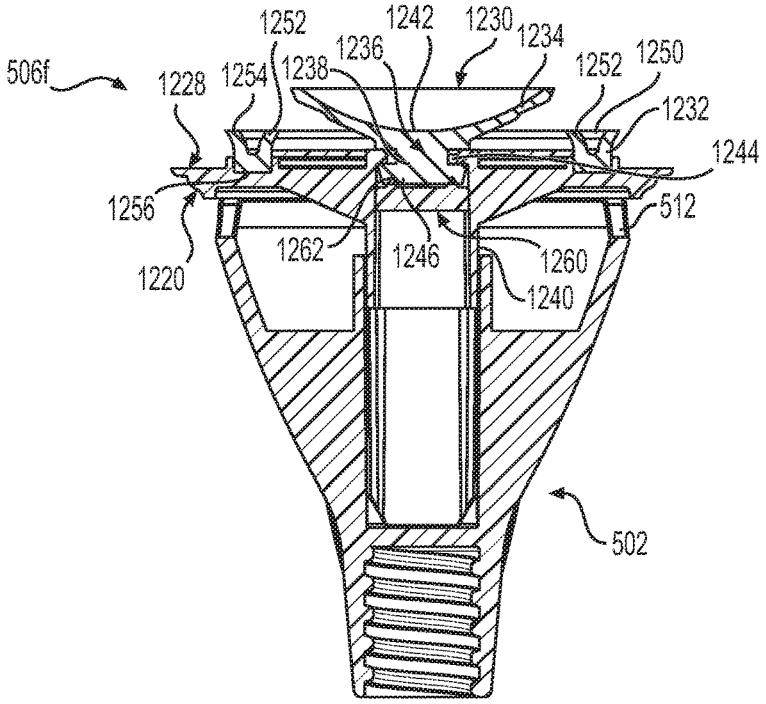
FIG. 14 is a cross-sectional view of the head piece illustrated in FIG. 12, taken along line 14-14 of FIG. 13.

FIGS. 12-14 illustrate a sixth exemplary embodiment of a selected head piece 506*f* that is mountable on the holder 502. The head piece 506*f* includes a base plate 1220 with first and second opposite sides 1222 and 1224 and a platform 1228. Primary and secondary gripping members 1230 and 1232 extend from the platform 1228 at the first side 1222 of the base plate 1220 for securely gripping the light bulb. An engagement member 1240 extends from the second side 1224 of the base plate 1220 for engaging the holder 502.

The primary gripping member 1230 is preferably a suction cup having an open face 1234 facing away from the platform 1228. The suction cup 1230 may be positioned substantially centrally with respect to the platform 1228 to engage the light bulb. The suction cup 1230 is preferably formed of rubber to apply sufficient suction when pushed against the light bulb for gripping the light bulb. The suction cup 1230 may be formed of any material that is capable of applying suction to the light bulb. The suction cup 1230 may be releasably coupled to the platform 1228 by an attachment member 1236, as seen in FIG. 14. The attachment member 1236 may include an extension 1238 extending from a bottom 1242 of the suction cup 1230. The extension 1238 may be configured to be received in a corresponding opening 1244 of the platform 1228. At the end of the extension 1238, a flange end 1246 is provided which catches against the platform to retain the suction cup 1230. Due to the flexible nature of the suction cup 1230, it may be removed from the platform opening 1244 with sufficient pulling force and replaced with sufficient pushing force. An optional anti-rotation member 1260 may be provided in the engagement 1240, which is preferably a stem, for engaging flange end 1246 and substantially preventing rotation of the suction cup 1230. The anti-rotation member 1260 may include teeth 1262, for example, that engage the bottom of the flanged end 1246 of the suction cup 1230, as seen in FIG. 14.

The secondary gripping member 1232 is preferably a channel 1250 that includes opposing first and second grip arms 1252 and 1254 for further gripping of the light bulb. The channel 1250 may be spaced from the perimeter of the base plate 1220 and substantially surround the suction cup 1230. The channel 1250 is preferably formed of rubber to provide a friction grip between its arms 1252 and 1254 and the light bulb. The channel 1250 may be formed of any material that is capable of sufficiently gripping the light bulb. The channel 1250 has a substantially circular shape and substantially circles the suction cup 1230. The suction cup 1230 preferably extends further away from the platform 1228 than does the channel 1250, as seen in FIGS. 13 and 14. The opposing first and second grip arms 1252 and 1254 may flare outwardly slightly to improve the grip on the light bulb, as seen in FIG. 14. The channel 1250 may reside in a substantially circular recessed groove 1256 formed in the platform 1228.

When using the adapter 500 with the head piece 506*f* of the sixth embodiment mounted thereon for changing a light bulb, the suction cup 1230 is first applied against the light bulb. The adapter is then moved or pushed toward the light bulb thereby compressing the suction cup 1230 against the light bulb to establish a suction grip of the light bulb. The adapter is pushed against the light bulb until the channel 1250 also grips the light bulb via a friction grip with the channel's grip arms 1252 and 1254. Once both the suction cup 1230 and the channel 1250 have both gripped the light bulb, the light bulb can be removed and changed. To release the light bulb from the adapter, the holder 502 is twisted and pulled with enough force to break the suction of the suction 1230 and friction grip of channel 1250.

To use the interchangeable adapter 500, the user selects one of the head pieces 506*a*, 506*b*, 506*c*, 506*d*, 506*e*, or 506*f* in accordance with the size and type of light bulb to be changed. The user can then assemble the selected head piece 506 on the holder 502 by placing the selected head piece 506 on the holder's interface end 510 and coupling the engagement members 514 and 540. The engagement members 514 and 540 are configured to releasably couple, such as by a friction fit, thereby allowing the user to grasp and remove the selected head piece 506 from the holder 502 and replace it with another head piece as desired.

While preferred embodiments and variations thereof have been set forth above, those skilled in the art who have reviewed the present disclosure will readily appreciate that other embodiments can be realized within the scope of the invention. For example, the holder, head pieces, the teeth, suction cup, and channel can have any proportions that are compatible with the light bulb to be changed, and the adapter can have any compatible number of teeth. The diameter and width of the teeth may be changed in accordance with the size and type of light bulb. Additionally, the number of teeth may be selected based on the light bulb being grasped, including just one tooth. Similarly, the diameter of the suction cup and channel may be changed in accordance with the size and type of light bulb. Also, the invention can be used with an LED light bulb or any other similar device. Moreover, any shape of any component (such as the body 200, 200*a*, 200*b*, 200*c*, and holder 502) can be used as long as the adapter still works. Therefore, the present invention should be construed as limited only by the appended claims.

We claim:

1. A head piece for an adapter for changing a light bulb, comprising:

a base plate, said base plate having opposite first and second sides, said base plate defining a platform at said first side;

a primary gripping member extending from said platform of said first side of said base plate away from said second side, said primary gripping member being positioned with respect to said platform to engage the light bulb, said primary gripping member is a suction cup having an open face facing away from said platform for gripping the light bulb, said suction cup including an attachment member for coupling to said platform, said attachment member including an extension extending from a bottom of said suction cup and received in an opening of said platform, and said extension including a flanged end for catching on said platform;

a secondary gripping member extending from said platform of said first side of said base plate away from said second side, said primary gripping member extending further away from said platform than does said secondary gripping member, said secondary gripping member surrounding said primary gripping member and being configured to grip the light bulb; and an engagement member extending from said second side of said base plate away from said first side for engaging a holder of the adapter.

2. A head piece according to claim 1, wherein said secondary gripping member is a channel that includes first and second grip arms for gripping the light bulb.

3. A head piece according to claim 2, wherein said base plate defines an outer perimeter; and said channel is spaced from said outer perimeter and is around said primary gripping member.

4. A head piece according to claim 3, wherein said channel resides in a circular recessed groove formed in said platform at said first side of said base plate.

5. A head piece according to claim 1, wherein said primary gripping member is a suction cup, said suction cup has an open face facing away from said platform for gripping the light bulb; and said secondary gripping member is a channel for gripping the light bulb.

6. A head piece according to claim 5, wherein each of said suction cup and said channel is formed of rubber.

7. An interchangeable adapter for changing a light bulb, comprising:

a holder having a mounting end and an interface end opposite said mounting end, and a first engagement member disposed inside of said holder; and at least one head piece separate from said holder and releasably coupled thereto at said interface end of said holder, said head piece including, a base plate having opposite first and second sides, said base plate defining a platform at said first side, a primary gripping member extending from said platform of said first side of said base plate away from said second side, said primary gripping member being positioned with respect to said platform to engage the light bulb, and said primary gripping member being a suction cup having an open face facing away from said platform for gripping the light bulb, a secondary gripping member extending from said platform of said first side of said base plate away from said second side, said primary gripping member extending further away from said platform than does said secondary gripping member, said secondary gripping member surrounding said primary gripping member and being configured to grip the light bulb, and said secondary gripping member being a channel that includes first and second grip arms for gripping the light bulb, and a second engagement member extending from said second side of said base plate away from said first side for engaging said first engagement member of said holder.

8. An interchangeable adapter according to claim 7, wherein each of said suction cup and said channel is formed of rubber.

9. An interchangeable adapter according to claim 7, wherein said suction cup includes an attachment member for coupling to said platform of said base plate.

10. An interchangeable adapter according to claim 7, wherein said base plate defines an outer perimeter; and said channel is spaced from said outer perimeter.

11. An interchangeable adapter according to claim 7, wherein a diameter of said platform of said base plate of said head piece is larger than a diameter of said interface end of said holder.

12. An interchangeable adapter according to claim 7, wherein said first and second engagement members are adapted to engage one another in a releasable friction fit.

13. A method for changing a light bulb, comprising the steps of:

providing an adapter having a holder and a head piece releasably mounted thereto, the head piece including a base plate having opposite first and second sides, the base plate defining a platform at said first side, a primary gripping member extending from the platform of the first side of the base plate away from said second side, said primary gripping member being a suction cup having an open face facing away from said platform for gripping the light bulb, and a secondary gripping member extending from the platform of the first side of the base plate away from the second side, the secondary gripping member being a channel surrounding the primary gripping member, and said channel including first and second grip arms for gripping the light bulb;

gripping the light bulb with the primary gripping member of the adapter; and subsequent to gripping the light bulb with the primary gripping member, moving the adapter toward the light bulb until the secondary gripping member grips the light bulb.

14. A method according to claim 13, further comprising the step of releasing the light bulb by twisting and pulling the adapter to break the grip of the primary and secondary gripping members.

15. A method according to claim 13, wherein the primary gripping member is a suction cup that grips the light bulb by suction.

16. A method according to claim 15, wherein the secondary gripping member is a channel that grips the light bulb by friction.

17. A method according to claim 16, wherein the step of moving the adapter toward the light bulb includes compressing the suction cup against the light bulb.

18. A headpiece for changing a lightbulb, comprising:

a base plate, said base plate having opposite first and second sides, said base plate defining a platform at said first side;

a primary gripping member extending from said platform of said first side of said base plate away from said second side, said primary gripping member being a suction cup positioned with respect to said platform to engage the light bulb, said suction cup having an open face facing away from said platform for gripping the light bulb;

a secondary gripping member extending from said platform of said first side of said base plate away from said second side, said secondary gripping member surrounding said primary gripping member being a channel configured to grip the light bulb, and said channel including first and second grip arms for gripping the light bulb; and an engagement member extending from said second side of said base plate away from said first side for engaging a holder of an adapter.

* * * * *